US007520588B2

(12) United States Patent
Domoto et al.

(10) Patent No.: US 7,520,588 B2
(45) Date of Patent: Apr. 21, 2009

(54) APPARATUS FOR REDUCING INK JET CONTAMINATION

(76) Inventors: Gerald A. Domoto, 444 Sleepy Hollow Rd., Briarcliff Manor, NY (US) 10510; Elias Panides, 18-06 Parsons Blvd., Whitestone, NY (US) 11357; Mark A. Cellura, 1531 Fieldcrest Dr., Webster, NY (US) 14580; Elliott A. Eklund, 34 Jackson Rd. Extension, Penfield, NY (US) 14526; Scott J. Phillips, 19 Chelsea Meadows Dr., West Henrietta, NY (US) 14586

( * ) Notice: Subject to any disclaimer, the term of this patent is extended or adjusted under 35 U.S.C. 154(b) by 393 days.

(21) Appl. No.: 11/318,284

(22) Filed: Dec. 23, 2005

(65) Prior Publication Data

US 2007/0146450 A1 Jun. 28, 2007

(51) Int. Cl.
*B41J 2/165* (2006.01)

(52) U.S. Cl. ..... 347/29

(58) Field of Classification Search ..... 347/22, 347/25, 82; 15/306.1, 316.1, 405
See application file for complete search history.

(56) References Cited

U.S. PATENT DOCUMENTS 4,411,706 A * 10/1983 Wallace et al. ..... 134/37
4,591,869 A 5/1986 Katerberg et al.
4,727,378 A * 2/1988 Le et al. ..... 347/35
4,764,780 A * 8/1988 Yamamori et al. ..... 347/21
4,928,114 A * 5/1990 Fagerquist et al. ..... 347/74
4,970,535 A * 11/1990 Oswald et al. ..... 347/25
5,519,420 A 5/1996 Zorn et al.
5,528,271 A * 6/1996 Ebisawa ..... 347/34
5,877,788 A * 3/1999 Haan et al. ..... 347/28
6,068,364 A * 5/2000 Kusumi et al. ..... 347/29
6,719,398 B1 * 4/2004 McElfresh et al. ..... 347/21
6,890,053 B2 5/2005 Myhill et al.
2003/0016267 A1 1/2003 Green
2005/0099451 A1 5/2005 Kuester et al.
2005/0157119 A1 7/2005 Silverbrook
2008/0036835 A1 * 2/2008 Domoto et al. ..... 347/88

* cited by examiner

*Primary Examiner*—Anh T. N. Vo

(57) ABSTRACT

An apparatus is used with an ink jet print head in an ink jet printer. The apparatus includes a print head protector that surrounds a print head. A substantially continuous slot is provided along a perimeter of the bracket and a filter is located in the substantially continuous slot. An inlet in fluid communication with the substantially continuous slot enables a positive pressure air supply to be coupled to the inlet. The air entering the inlet flows through the filter in the slot and the filtered air flows outwardly away from the print head.

18 Claims, 7 Drawing Sheets

APPARATUS FOR REDUCING INK JET CONTAMINATION

TECHNICAL FIELD

This disclosure relates generally to ink printers, and particularly to print heads used in ink printers.

BACKGROUND

Solid ink or phase change ink printers conventionally receive ink in a solid form, either as pellets or as ink sticks. The solid ink pellets or ink sticks are placed in a feed chute and a feed mechanism delivers the solid ink to a heater assembly. Solid ink sticks are either gravity fed or urged by a spring through the feed chute toward a heater plate in the heater assembly. The heater plate melts the solid ink impinging on the plate into a liquid that is delivered to a print head for jetting onto a recording medium. U.S. Pat. No. 5,734,402 for a Solid Ink Feed System, issued Mar. 31, 1998 to Rousseau et al.; and U.S. Pat. No. 5,861,903 for an Ink Feed System, issued Jan. 19, 1999 to Crawford et al. describe exemplary systems for delivering solid ink sticks into a phase change ink printer.

Once the ink is melted, it typically drips into an ink reservoir. The reservoir is coupled by conduits to a print head for jetting the liquid ink onto the recording medium. In color printers, a print head is provided for each composite color. For example, a color printer may have one print head for emitting black ink, another print head for emitting yellow ink, another print head for emitting cyan ink, and another print head for emitting magenta ink. Color images may be comprised of four images, one for each of the composite colors. The image data for each of the composite colors are provided to a print head controller for generation of a color image.

The print head controller uses the image data for a composite color to control the operation of the print head for the corresponding composite color. In some ink printers, the ink may be emitted by a print head directly onto a sheet of recording medium. In other printers called offset printers, the ink is emitted onto an intermediate revolving imaging drum. When an intermediate imaging drum is used, several revolutions of the imaging drum may occur before the complete image is generated. Once the image is generated, a transfer roller engages the imaging drum and a sheet of recording medium is fed into the nip between the imaging drum and the transfer roller. The pressure and heat in the nip transfer the inked image from the imaging drum onto the recording medium. The sheet bearing the image, in both direct and offset printing, is then transported to a discharge area.

The print head in an ink printer may be comprised of many piezoelectric ejectors that expel a small amount of ink when energized by a voltage signal. The ejectors are arranged in a print head in a row and column matrix. The voltage signals for the ejectors are selectively generated by the print head controller in correspondence with the pixilated image data. Thus, the print head controller causes the ejectors of the print head to emit droplets of ink that are deposited on a media sheet or an imaging drum as it passes the print head to form an image.

Recording media sheets, particularly paper, can produce fibers and other particulate matter as they move from the supply stack through the transfer nip to the discharge area. These particulates and fibers along with dust typically present in air may enter the gap between a print head and an imaging drum. Some of the fibers and particulate may clog nozzles of the ejectors in a print head. The risk of paper fibers and particulates clogging print head nozzles is especially present in direct printing machines because the media sheet is brought so close to the print head for printing. Clogged nozzles adversely impact the quality of the images generated by the printing machine.

SUMMARY

An apparatus disclosed herein reduces the risk of clogged nozzles in ink jet printing machines by providing a positive flow of filtered air around the perimeter of the print head. The apparatus includes a print head protector for providing a plenum that surrounds a print head. A substantially continuous slot is provided along at least a portion of a length of the protector and a filter is located in the substantially continuous slot. An inlet in fluid communication with the substantially continuous slot enables a positive pressure air supply to be coupled to the inlet. The air entering the inlet flows through the filter in the slot and the filtered air flows outwardly away from the print head to produce a higher pressure within the plenum than surrounding print head environment outside the protector. Thus, fibers and particulates are swept by the air flow away from the print head.

DETAILED DESCRIPTION

Figure 1:
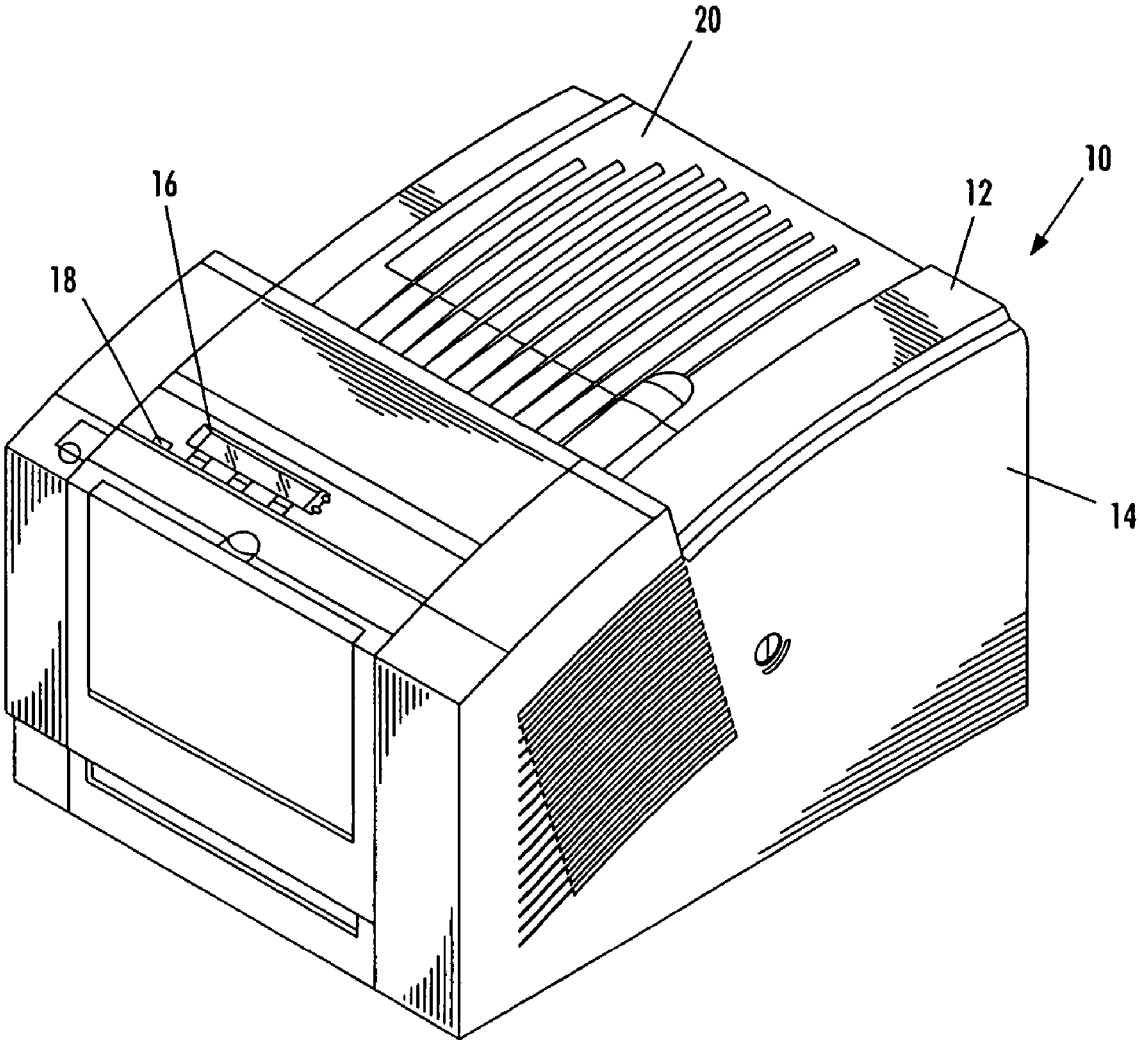
FIG. 1 is a perspective view of a phase change printer with the printer top cover closed.

FIG. 1 shows a solid ink, or phase change, ink printer 10 in which a print head protector may be used to reduce the risk of nozzle clogging from particulate and fiber in the air. The printer 10 includes an outer housing having a top surface 12 and side surfaces 14. A user interface display, such as a front panel display screen 16, displays information concerning the status of the printer, and user instructions. Buttons 18 or other control elements for controlling operation of the printer are adjacent the user interface window, or may be at other locations on the printer.

An ink jet printing mechanism (not shown) is contained inside the housing. A printing mechanism for offset printing is described in U.S. Pat. No. 5,805,191, entitled Surface Application System, to Jones et al. A printing mechanism for direct printing of a recording media sheet is described in U.S. Pat. No. 5,455,604, entitled Ink Jet Printer Architecture and Method, to Adams et al. Both of these printing mechanisms include a rotating drum that is separated from the print head by a small gap. In the direct printing machine, the recording media sheet is fed into this gap so that ink may be ejected from the print head onto the recording media sheet. In the offset printing machine, the ink is ejected from the print head onto the imaging drum and subsequently transferred to a recording media sheet.

In both types of printing machines, the ink jet print head is typically mounted to a pair of rails and driven in a conventional manner by a motor transversely across the sheet of print media or the face of the imaging drum to scan the media or drum during the printing operation. The ink jet print head ejects ink toward the print media or the imaging drum while the sheet or drum is positioned in a print zone. This printing may continue as the print media is transported through the zone by the rotation of the drum supporting the media or as the imaging drum rotates past the print head.

The ink jet print heads used in both types of printing machines may use acoustic drivers, and more specifically piezoceramic materials, for generating a pressure wave in the ink jet print head in response to drive signals. These pressure waves cause the ejection of ink drops from associated nozzle orifices on demand. Resolutions of 300 dots/inch or more can be achieved using ink jet print heads of this type. Also, these ink jet print heads may be utilized for ejecting drops of hot-melt or phase-change ink toward print media, as well as for ejecting non-hot-melt ink, such as aqueous ink. In the case of hot-melt ink jet printers, heaters are included to heat the ink reservoir and ink jet print head to maintain the ink in a liquid state for jetting purposes. Ink drops or spots are thus applied to the print media or an imaging drum during printing.

A color printer typically uses four colors of ink (yellow, cyan, magenta, and black). Ink sticks 30 of each color are delivered through separate feed channels to a melt plate. Consequently, each channel has a melt plate, ink reservoir, and print head that is independent from the corresponding components for the other colors. The print heads may be located at different positions about the centrally located rotating drum.

In the direct printing machines, the print media sheets, particularly paper, may carry particulates and fibers into the printing zone opposite the print head. These particulates and fibers may dislodge from the sheet and migrate towards the nozzle orifices in the print head. Some of this debris may become lodged in the orifices, either temporarily or permanently. The clogged nozzles degrade the quality of the images printed on the media sheets.

Even in offset printing machines, the risk of clogged nozzle orifices from floating debris remains. The sheet supply in offset printing machines may be fluffed to assist removal of the top sheet from the sheet supply. This fluffing may release or loosen fibers and particulates that become suspended in the air at the supply. This air may then be carried by currents within the machine to the printing zone. Also, the sheets are brought to a position proximate to the imaging drum for transfer of the image from the imaging drum to the sheet media. The movement may also dislodge fibers and particulates into the print head environment that may later clog nozzle orifices.

Figure 2:
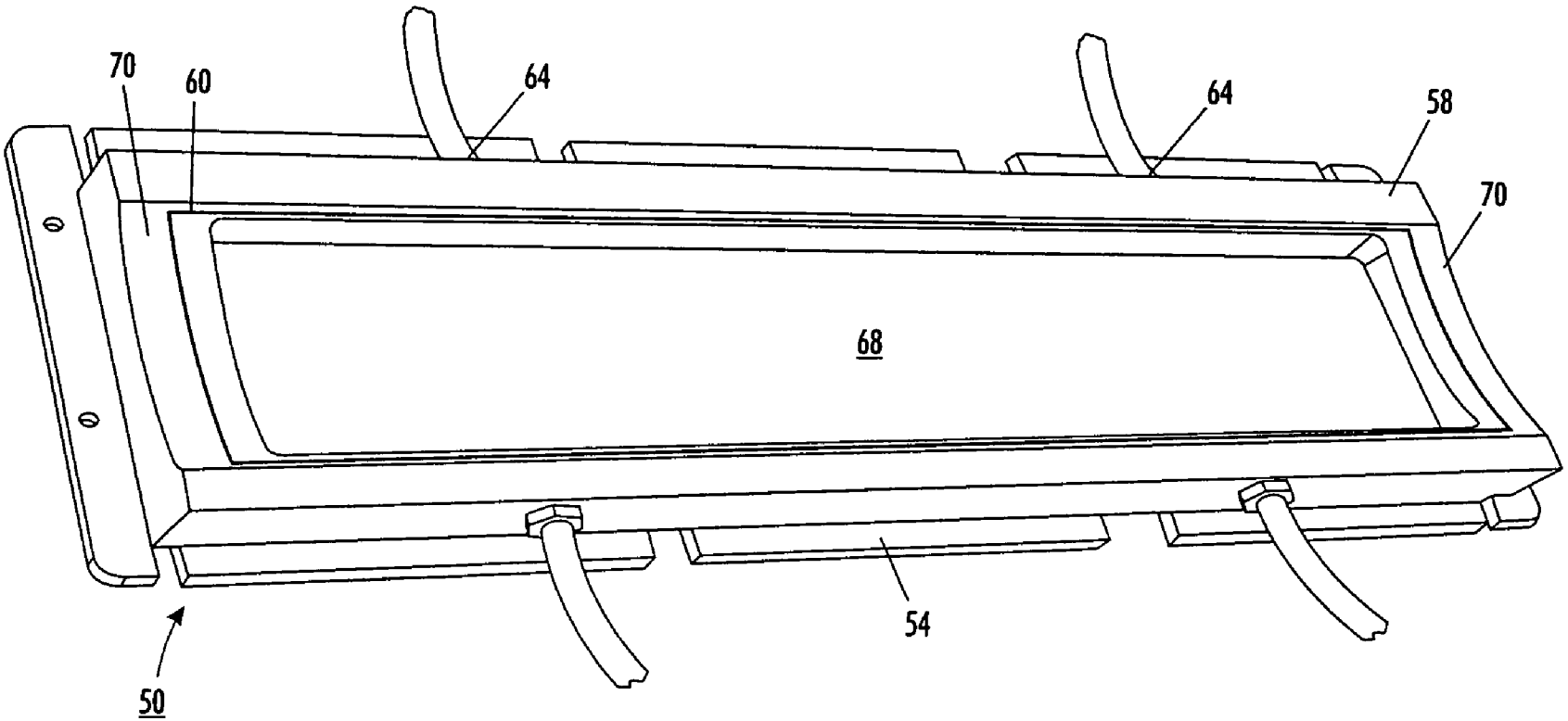
FIG. 2 is a perspective view of one embodiment of the print head protector displaying the plenum.

The print head protector shown in FIG. 2 may be installed in direct printers and offset printers to reduce the risk of clogged nozzle orifices from debris in the vicinity of the print head. The print head protector 50 includes a plate 54 and a barrier wall 58 extending upwardly from the plate. The wall 58 has a substantially continuous slot 60 formed therein. The slot 60 in the wall 58 is in fluid communication with one or more inlets 64 in wall 58. The inlets 64 enable a positive pressure air supply (not shown) to be coupled to the protector 50 so that air may be emitted from the slot 60.

The slot 60 may be continuously formed around the perimeter or it may be an intermittent slotted structure. Although shown as being straight walled, the slot 60 may be a plurality of cylindrical, elliptical, or other non-linear shaped openings. A recess 68 is housed within the wall 58. When a positive pressure air supply is coupled to the protector 50 so air is emitted from the slot 60, the pressure within the recess 68 is greater than the ambient pressure outside the protector 50. Thus, the recess 68 acts as a plenum when a positive pressure air supply is coupled to the protector 50. That is, the positive pressure source generates a quiescent area of static pressure within the recess that is greater than static pressure outside the quiescent pressure area within the recess 68 and its periphery. This quiescent higher pressure reduces the risk of particulates and fibers entering the space proximate the print head without causing significant air currents in that space that may adversely impact the ejection of ink drops from the print head onto an imaging drum or media sheet. If a plurality of inlets 64 is provided, one of the inlets may be used to house a pressure transducer to monitor the pressure within the plenum of the protector 50. The slot 60 may also include a filter so that the air emitted from the slot is relatively clean and free of debris. The filter openings are sized to remove particulates the smallest particulates of interest for the print head environment. In one embodiment, the filter is structured to remove particulates of 10 microns in diameter or larger. Of course, the filter may be placed in the air stream of the positive pressure air supply before it reaches an inlet in the wall 58.

The print head protector shown in FIG. 2 may be milled from stainless steel or aluminum or the like. In another embodiment, the protector may be formed from composite lightweight material, such as graphite composites. The plate may be formed with apertures for receiving fasteners so the protector may be mounted to a bracket or other supporting structure proximate to a print head. In printing machines having more than one print head, the protector may be made large enough to encompass all of the print heads in a single plenum or each print head may be provided with a print head protector.

Figure 3:
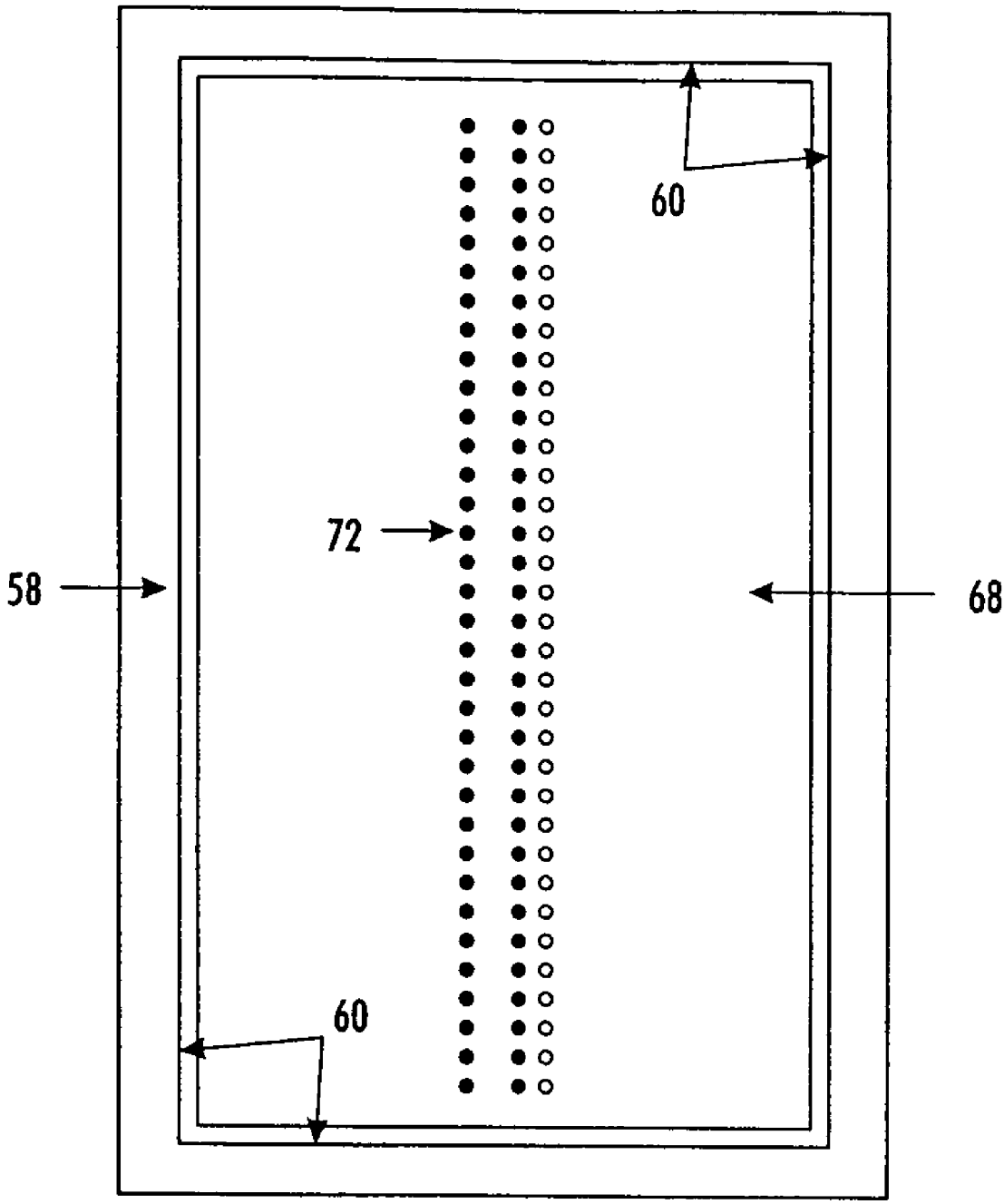
FIG. 3 is a schematic diagram of the print head protector embodiment shown in FIG. 2.

As shown in FIG. 3, the print head protector 50 is mounted about a print head so that the nozzles 72 of the print head are within the recess 68. The slot 60 is shown as extending continuously around the perimeter of the protector 50. As air is emitted at the slot 60, the recess 68 reaches a higher pressure than the ambient air outside the protector 50. When a filter is used to clean the air flowing out of the slot 60, the air in the immediate vicinity of the print head has fewer particulates and fibers in it than the ambient air. The positive pressure helps keep the relatively dirty air outside the protector from entering the immediate environment of the print head.

In an effort to preserve the positive pressure in the plenum, embodiments of the protector that are mounted in proximity to rotating drums are curved at the outboard ends 70 of the wall 58 as shown in FIG. 2. The curve of these ends corresponds to the radius of curvature for the rotating drum opposite the print head surrounded by the plenum. By curving these ends, a uniform gap between the slot 60 in the wall 58 and the rotating drum is maintained. The size of this gap is important for maintaining the pressure differential between the plenum and the ambient air. This gap should be comparable to the gap between the ink jet nozzles and the rotating drum. In one embodiment, the gap is the same as the ink jet nozzle/rotating drum gap, which is 0.508 mm.

Figure 4:
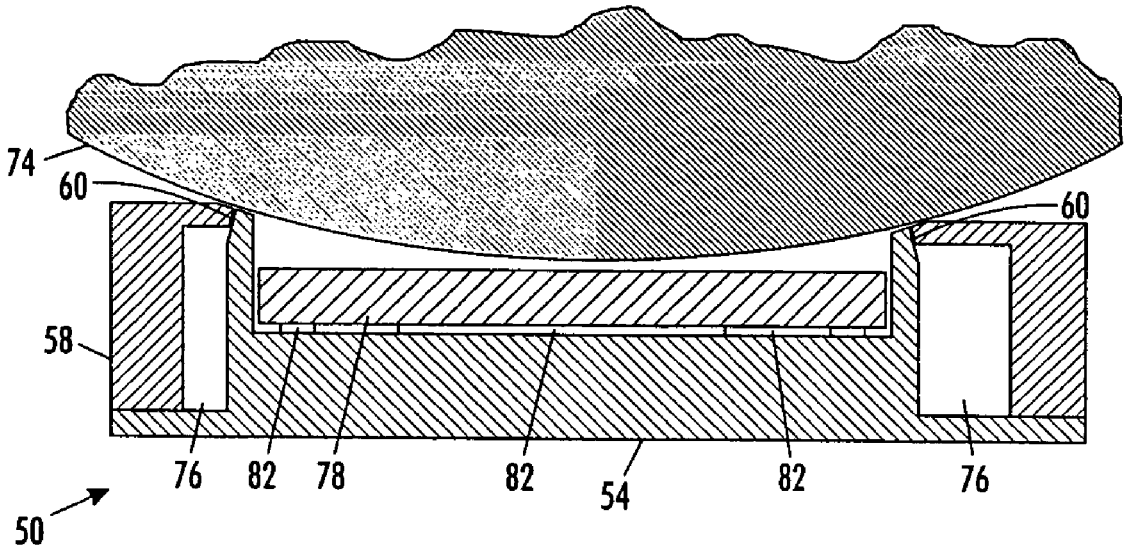
FIG. 4 is a cross-sectional view of an embodiment of the print head protector in relation to the rotating drum and the print head.

A cross-sectional view of one embodiment of the print head protector is shown in FIG. 4. The protector 50 includes two components, the plate 54 and the wall 58. The plate 54 and wall 58 are formed so they come within approximately 200 microns of one another at slot 60. Behind slot 60, wall 58 and plate 54 are configured to form a manifold space 76 between them. The manifold space 76 is in fluid communication with the inlet 64 and the slot 60. The air from the positive pressure air supply generates a pressure in the manifold space 76 that stabilizes the pressure within the protector 50 even though a pressure differential occurs at the slot 60 as the air is emitted through the slot. The recessed area of the plate 54 surrounds the print head 78 so a positive static pressure may be established in the vicinity of the print head.

The plate 54 and the wall 58 may be configured so that a slot exists only on the upstream side of the print head 78, which is the left side of FIG. 4 as the drum 74 rotates in the counterclockwise direction. In this embodiment, the plate 54 and the wall 58 may be configured to provide the manifold space 76 only on the downstream side as well, depending upon the volume required to stabilize the pressure in protector 50. This embodiment sufficiently removes debris from the drum or media sheet that the risk of nozzle clogging is substantially reduced. To ensure that the plenum in such embodiments remains at a pressure greater than the one outside the protector, the uniformity of the gap between the protector 50 and the rotating drum 74 may require more precision. As shown in FIG. 4, the print head 78 is supported on the plate 54 by a plurality of pads 82.

Figure 5:
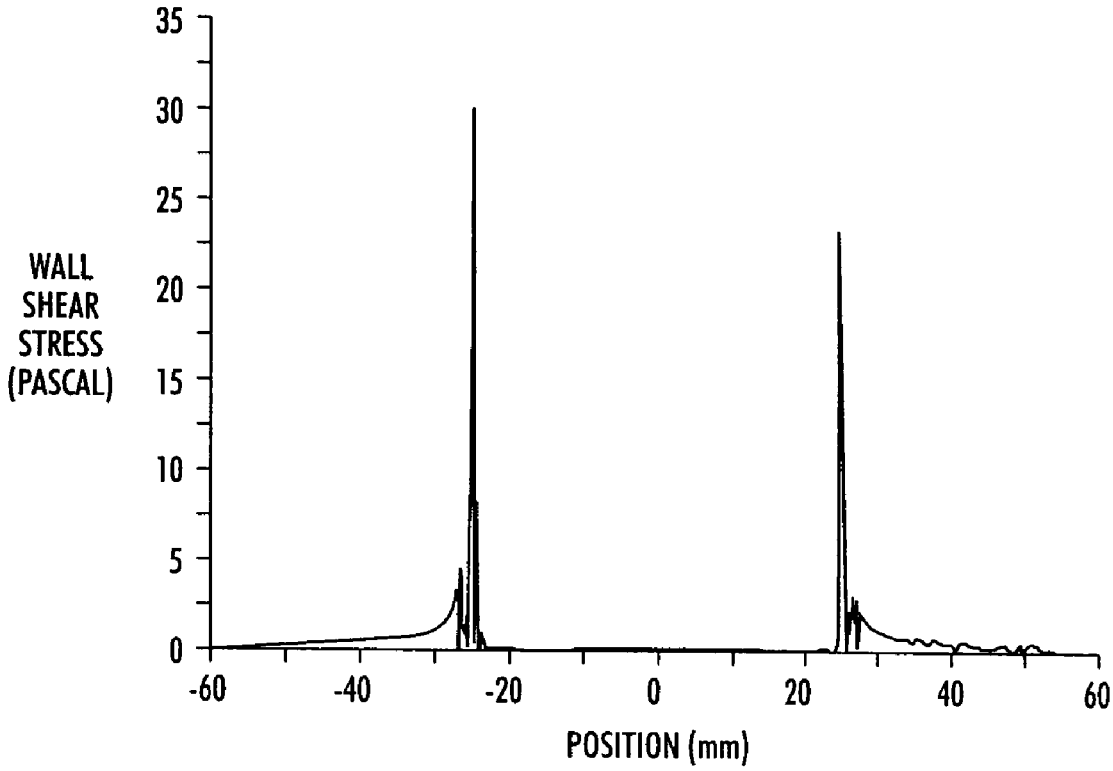
FIG. 5 is a graph depicting shear stress distribution on the surface of the rotating drum generated by the air flow from an embodiment of the print head protector.

The graph shown in FIG. 5 demonstrates the shear stress generated by the air flow at the slot 60. The stress, measured in pascals, is shown at distances relative to the center of the plenum. As shown in the figure, the shear stress is the greatest at the upstream slot position. The next greatest shear occurs at the downstream slot position. The shear at the upstream position helps ensure that fibers and particulates are dislodged from a media sheet or drum surface before they enter the plenum, while also preventing those particulates and fibers from entering the plenum. The shear at the downstream side helps prevent the ingress of particulate and fibers that may be present in the ambient air.

In one embodiment, a protector 50 has a slot 60 that is approximately 4 mm deep, 200 microns wide, and is 12 inches long at the upstream side. The protector 50 was mounted proximate to a rotating drum so that the ink jet/drum gap and the slot/drum gap was approximately 0.508 mm. The 11.89 inch diameter drum rotated at an angular speed of 21.1 rads/seconds in the counterclockwise direction. To maintain positive pressure in the plenum, the average air speed in the slot 60 was 20 m/s or 2.6 cubic feet per minute. The pressure of the air supply to maintain this flow rate was 630 Pa or approximately 2.5 inches of water. The slot has been determined to only require a depth that is 5-10 times its width. Thus, a depth of 1 mm would be sufficient. Such an embodiment would reduce the pressure needed for the air supply by a factor of four.

Figure 6A:
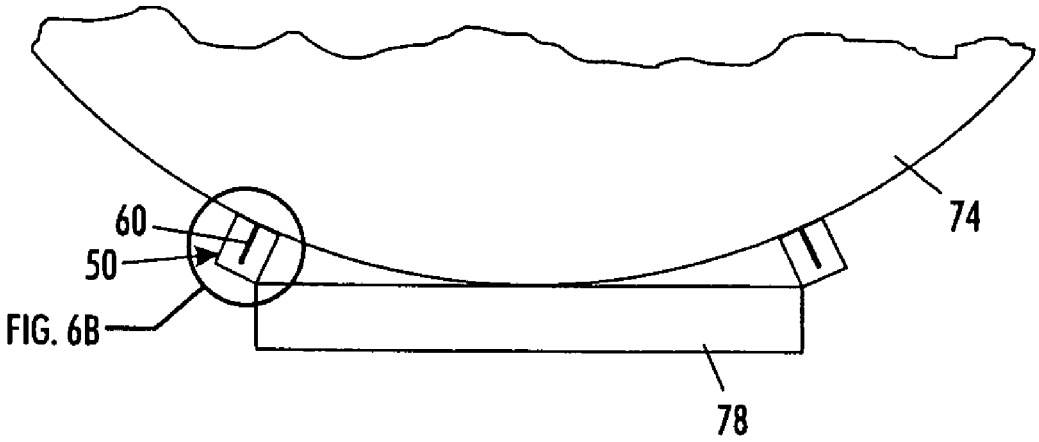
FIG. 6A depicts the relationship of the slot in the print head protector to the rotating drum and the print head.
Figure 6B:
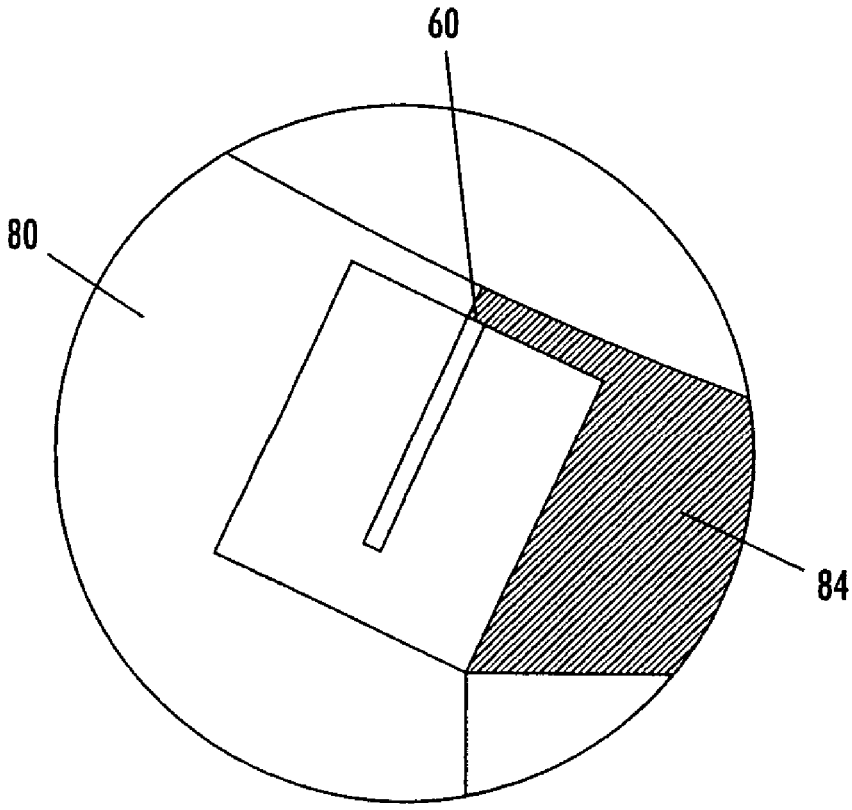
FIG. 6B depicts a simulation of the static pressure zones arising from the air flow from the slot shown in FIG. 6A.

FIG. 6A shows the relationship of the slot 60 to the rotating drum 74 and the print head 78. In the figure, air is emitted from the slot 60 in the wall 58 so it impinges on the drum 74. The resulting curtain of air generates two static pressure zones that are depicted in the detail figure shown in FIG. 6B. The area 80 is at a lower average static pressure than the average static pressure in the shaded area 84. This higher static pressure is in the area where the print head ejects the ink. In one embodiment, the range of static pressure in the area 84 was 80 to 90 Pa. This pressure helps prevent particulate matter from flowing into the plenum from the area outside the protector.

Figure 7A:
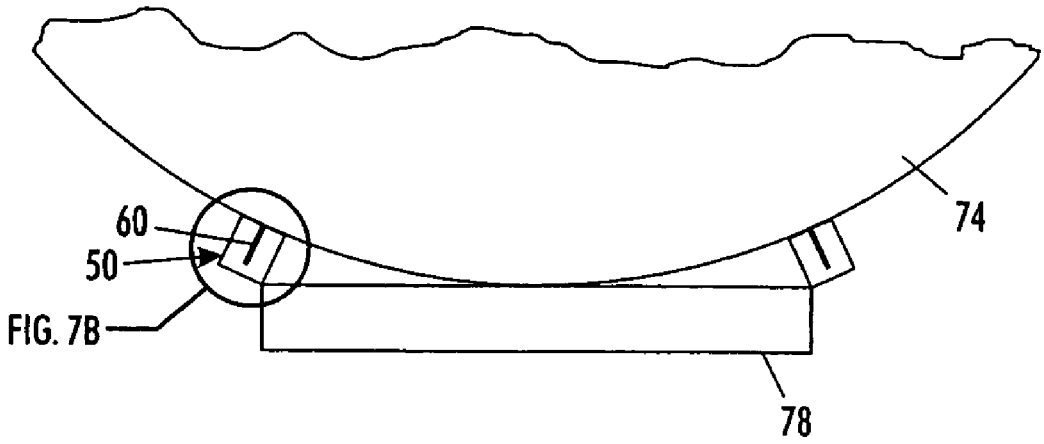
FIG. 7A depicts the relationship of the slot in the print head protector to the rotating drum and the print head.
Figure 7B:
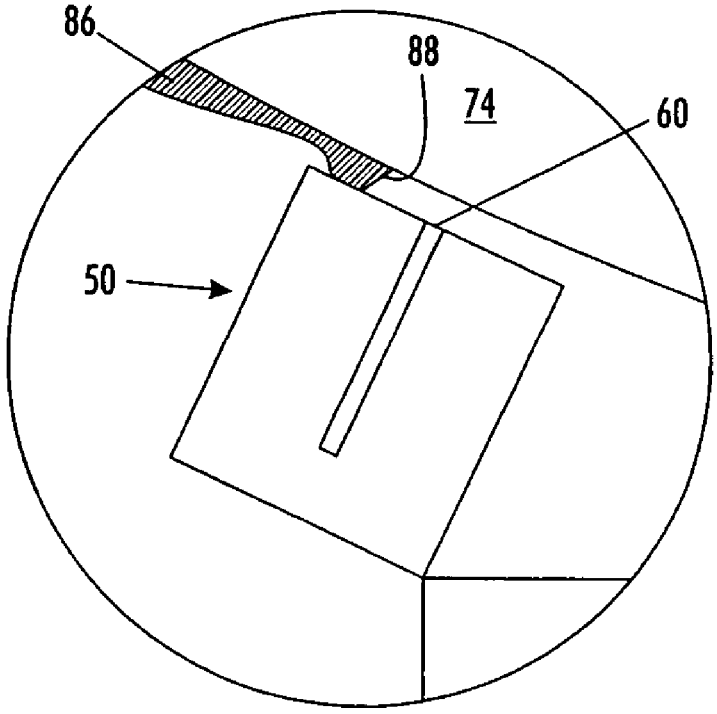
FIG. 7B depicts a simulation of particulate repulsion from the plenum surrounding the print head.

FIG. 7A again depicts the relationship of the slot 60 to the rotating drum 74 and the print head 78. As shown in the detail of FIG. 7B, particulates 86 at or near the surface of the drum are pushed away from the higher pressure area as they enter the gap 88. The particulates are then returned to the lower pressure area outside of the protector 50.

Maintaining pressure within the plenum is affected by the angle of the slot to the drum surface. In the figures presented herewith, the slot is practically normal to the drum surface. In embodiments where lower pressures are appropriate for the geometries and dimensions discussed above, the slots may be formed in the wall of the protector so they angle outwardly from the plenum. For embodiments where higher pressures are appropriate within these parameters, the slots may be angled inwardly towards the plenum.

Those skilled in the art will recognize that numerous modifications can be made to the specific implementations described above. For example, the print head protector disclosed herein may be adapted for web printing processes and machines. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. An apparatus for use with a print head in an ink printing machine, the apparatus includes:

a print head protector having a plate and a wall extending from the plate to form a recess in which the print head is located, the plate and the wall being configured to form a manifold space between the plate and the wall;

a substantially continuous slot formed in the wall; and an inlet in fluid communication with the manifold space and the substantially continuous slot, the inlet being configured to be coupled to a positive pressure air supply to enable pressurized air to flow from the positive pressure air supply through the inlet and the manifold space before being emitted out of the slot, the flow of air out of the slot generating a pressure in the recess that is greater than a pressure outside the wall of the protector to keep debris from passing by the slot towards the print head during printing.

2. The apparatus of claim 1 wherein the wall and the substantially continuous slot extend around a perimeter of the print head protector.

3. The apparatus of claim 2 wherein the substantially continuous slot has a width of approximately 200 microns.

4. The apparatus of claim 2 further comprising:

a filter within the substantially continuous slot.

5. The apparatus of claim 1 wherein outboard ends of the print head protector are curved to correspond to a radius of curvature for a rotating drum opposite the print head enclosed within the print head protector.

6. The apparatus of claim 5 wherein the air from the slot is at a normal angle to the drum surface.

7. The apparatus of claim 5 wherein the air emitted from the slot is angled away from ink ejected from the print head.

8. The apparatus of claim 1 wherein the air flowing through the substantially continuous slot flows at a rate of approximately 2.6 cubic feet per minute.

9. An ink printing machine having an apparatus associated with a print head, the ink printing machine including:

a rotating drum;

the print head located proximate the rotating drum, the print head having a plurality of ink jets for ejecting ink to form an image on the rotating drum;

a print head protector having a plate and a wall extend in from the plate to form a recess in which the print head is located, the plate and the wall of the protector being configured to form a manifold space between the wall and the plate and the wall having a substantially continuous slot along a portion of a length of the protector; and an inlet in fluid communication with the substantially continuous slot through the manifold space, the inlet being configured to be coupled to a positive pressure air supply to enable pressurized air to flow from the positive pressure air supply through the inlet and the manifold space before being emitted out of the slot to impinge upon the rotating drum surface, the flow of air out of the slot generating a pressure in the recess that is greater than a pressure outside the wall of the protector to keep debris from passing by the slot towards the print head during printing.

10. The ink printing machine of claim 9 wherein the wall and the substantially continuous slot extends around a perimeter of the print head protector.

11. The ink printing machine of claim 10 wherein the substantially continuous slot has a width of approximately 200 microns.

12. The ink printing machine of claim 10 wherein outboard ends of the print head protector are curved to correspond to a radius of curvature for the rotating drum to enable a uniform gap to be maintained between the protector and the rotating drum.

13. The ink printing machine of claim 12 wherein the air from the slot is at a normal angle to the rotating drum.

14. The ink printing machine of claim 12 wherein the air from the slot is directed at an angle towards the rotating drum.

15. The ink printing machine of claim 10 further comprising:

a filter within the substantially continuous slot.

16. The ink printing machine of claim 9 wherein the air flowing through the substantially continuous slot flows at a rate of approximately 2.6 cubic feet per minute.

17. The ink printing machine of claim 9 wherein the rotating drum is an intermediate imaging drum.

18. The ink printing machine of claim 9 wherein the rotating drum is a transport drum for passing a media sheet in front of the print head to enable the print head to eject ink directly onto the media sheet.

* * * * *

UNITED STATES PATENT AND TRADEMARK OFFICE

CERTIFICATE OF CORRECTION

PATENT NO. : 7,520,588 B2
APPLICATION NO. : 11/318284
DATED : April 21, 2009
INVENTOR(S) : Domoto et al.

It is certified that error appears in the above-identified patent and that said Letters Patent is hereby corrected as shown below:

On the Title Page, Item (73) is inserted to include

--(73) Assignee: Xerox Corporation
Norwalk, Connecticut--

Signed and Sealed this

Ninth Day of June, 2009

JOHN DOLL
*Acting Director of the United States Patent and Trademark Office*